US007360499B1

(12) United States Patent
O'Neill

(10) Patent No.: US 7,360,499 B1
(45) Date of Patent: Apr. 22, 2008

(54) HELMHOLTZ RESONATOR TYPE MARINE SIGNAL

(75) Inventor: Robert M. O'Neill, Oxford, MS (US)

(73) Assignee: Essi Corporation, Broussard, LA (US)

( * ) Notice: Subject to any disclaimer, the term of this patent is extended or adjusted under 35 U.S.C. 154(b) by 105 days.

(21) Appl. No.: 11/267,117

(22) Filed: Nov. 3, 2005

Related U.S. Application Data

(60) Provisional application No. 60/638,492, filed on Dec. 21, 2004.

(51) Int. Cl.
*B63B 45/04* (2006.01)

(52) U.S. Cl. ..... 116/26; 116/137 R; 181/149; 181/192; 381/423

(58) Field of Classification Search ..... 116/26, 116/137 R, DIG. 43, DIG. 18, DIG. 19; 181/152, 148–149, 157, 159, 192, 198, 182–184; 340/388.1, 388.4, 384.1, 392.4; 381/342, 381/340, 345, 423
See application file for complete search history.

(56) References Cited

U.S. PATENT DOCUMENTS 3,153,783 A * 10/1964 Whitehead ..... 340/384.71
4,796,009 A 1/1989 Biersach
4,908,601 A 3/1990 Howze
5,146,508 A 9/1992 Bader et al.
5,321,388 A 6/1994 Biersach
5,726,396 A 3/1998 Erath

OTHER PUBLICATIONS

AB 26 Audiobeam ½ Mile Fog Signal,Web Site of Tideland Signal Corp. (www.tidelandsignal.com) USA.
SOLA ET 500 Sound Emitter, brochure, Sola Communications, Inc. USA.

* cited by examiner

*Primary Examiner*—R. A. Smith
*Assistant Examiner*—Tania C Courson
(74) *Attorney, Agent, or Firm*—Robert N. Montgomery

(57) ABSTRACT

A power efficient, acoustical Helmholtz resonator foghorn including a plurality of electrical emitters, some of which are redundant, arrayed at one end of a blocked tube with a plurality of exhaust ports located therein surrounded by a standoff tubular member. The foghorn tuned to provide a high pitch thus providing a compact horn having an acoustical path capable of producing an exceptional wavelength in a generally concentric horizontal sound propagation the horn configurable for use as either a one-half mile or two mile marine navigational aid for offshore structures, buoys, and the like.

18 Claims, 6 Drawing Sheets

HELMHOLTZ RESONATOR TYPE MARINE SIGNAL

1. FIELD OF THE INVENTION

This is a Non-provisional application relying on our provisional application No. 60/638,492 filed Dec. 21, 2004.

The present invention pertains to an apparatus for amplifying and directing audible sound waves. More particularly, the present invention relates to acoustical horns included in marine navigational assemblies such as marine foghorns and sirens and the like especially those utilizing high pitch, horizontal wave propagation.

2. GENERAL BACKGROUND

Long range atmospheric signaling devices such as fog horns and the like are federally mandated as aids to navigation in off shore environments where hazardous surface or sub-sea obstacles limit marine navigation.

It is known within the art that by augmenting the transmission of audible sound waves, emanating from a sound source generator, with an acoustical transmission path from the outlet of the driver into the throat of a tube of some selected shape and size and directed out of a mouth located at the end or along the tube, high pitched sounds can be produced that carry for long distances. The frequency response of the horn and its performance is a function of the frequency of sound introduced into the horn, its shape and the length of the sound path. Additionally, the shape of the horn's throat and mouth determine the directional characteristics of the horn as a function of the sound frequency and pressure. Horns are selected to fit particular applications of the sounds being generated. For example, a horn in the form of an elongated cylindrical tube will propagate sounds for which the length of the pipe is equal to an odd number of quarter wavelengths. The frequency response of such a tubular horn features a relatively high amplitude spike at the frequency corresponding to the wavelength that is four times the length of the pipe, and is zero for lower frequencies. The tubular horn will transmit harmonics of the frequency at the spike, but at smaller amplitudes. A tubular horn is therefore suitable for use in propagating sound of a single frequency.

A horn that flares, such as a horn featuring a cross section that increases with distance from the throat of the horn to its mouth, generally has a frequency response that goes to zero for sound frequencies below a cutoff frequency whose wavelength is equal to four times the length of the horn. However, the cutoff frequency tends to flatten for higher sound frequencies and smaller wavelengths. A horn with a constant flare rate, such as an exponential horn in which the cross-sectional area doubles for equal increments of length of the horn, tends to provide a broad, useful bandwidth beyond the cutoff frequency of the horn.

In general, the longest wavelength of sound for which a horn is an effective sound propagator is equal to four times the length of the horn or four times the acoustical transmission path defined by the horn. For sound of shorter wavelengths, the effectiveness of the horn as a sound transmitter depends upon the shape of the horn, that is, dependent upon the flare of the horn and the mouth of the horn. Therefore, the mouth of the horn determines directional characteristics of sound transmitted by a horn.

It is particularly important in the field of acoustical warning signals, such as those produced by sirens and marine foghorns, that the sound must be transmitted over long distances, even though the frequencies of the sounds may be limited. Foghorns generally produce only one or two basic sound frequencies. Further, such warning signals may be concentrated in a selected range of directions. For example, a warning horn set to mark a hazard at sea need not direct sound vertically and can, in fact, concentrate the sound propagation generally horizontally. Also, such a warning horn may limit the horizontal arc through which the sound is propagated, there being no need to direct sound on shore, for example. Further, to maximize the effectiveness of a horn to transmit selected sounds produced by a sound driver, the acoustical transmission path provided by the horn should be tuned to the wavelength of the sounds. Therefore, for a limited horizontal range and a single frequency a relatively short, non-expanding throat may be used with a tuned opening to provide a specific pressure wavelength.

Foghorns and warning horns are often placed in harsh environments, such as on promontories, buoys and marine vessels, where they are subjected to wind, water, and ice. Therefore, it is essential that such horns do not become a funnel for directing water into the throat of the horn and into contact with the driver. It is therefore advantageous to utilize a horn that is configured to be self-draining in a manner whereby the driver or drivers are protected and inaccessible by water condensate and the like.

More specifically the prior art teaches us that foghorns are generally designed to meet various range requirements, for example one-half mile or two-mile models. Typically one-half mile models are known as single emitters where a single transducer (emitter) is used to excite a resonant device. These resonate devices, include acoustical pipe resonators or Helmholtz resonators, which may be used to provide acoustic amplification to the acoustic signal, generated by providing an electrical input to the transducer. Typically, two-mile model designs consist of a plurality of emitters and acoustical resonators arranged in a vertical stack to produce the required sound pressure levels required by federal regulations. It can therefore be understood that the prior art does not teach the need for converting a one-half mile signal to a two mile signal for the same structure and in most cases simply adding more emitters or another emitter/resonator either exceed the federal regulations or tend to cancel each other.

The prior art further fails to teach energy conservation by reducing the electrical load by using a plurality of redundant emitters with a single resonator to achieve a desired frequency.

4. SUMMARY OF THE INVENTION

The instant fog horn assembly and system is an electrical powered navigation fog signal apparatus used for automatically broadcasting a 360 degree propagated pressure wave of sound in a horizontal plane at a prescribed frequency out to a minimum distance of one-half mile. The horn assembly is also suitable for Class 1, Division 2, Group D, hazardous locations. The system includes low voltage D.C. primary and secondary energy cells with a solar power generator.

The present invention provides an acoustical horn for use with a plurality of sound generators thereby providing redundancy and reduced power requirement. The sound generators or acoustic drivers are located within an explosion proof segment of the assembly with the horn's throat defining an acoustical transmission path the cross-section of which is generally concentric about its central vertical axis. The upper explosion proof segment of the horn is a hollow housing having a removable portion containing the power amplifier, control circuitry, power regulators and the acoustic drivers fixed to a deep throat tubular portion with a general planer surface at its opposite end, the throat being peripherally penetrated by generally rectangular orifices. A tubular element concentrically surrounding the orifices is held in standoff suspension by baffle spacers, with the inner surfaces of the tubular segment and the general outer surface of the throat tubular portion forming a concentric dual throat acoustical transmission path.

The horn may be constructed from light weight materials, including plastics, and provides maximum protection for the drivers while producing a compact horn having an acoustical path capable of producing and exceptional wavelength in a generally concentric horizontal sound propagation.

The lateral dimensions of the acoustical transmission path perpendicular to the direction of propagation along the path and in a plane containing the central axis may be considered to proceed abruptly from one segment of the path to the next, as well as to expand aggressively at its ports. The present invention is a essentially a super reliable Helmholtz resonator horn in the form of an acoustical mass capacitor and inductor producing a resonant circuit having a lateral dispersion of the sound with propagation in a 360-degree acoustical path radially about the central axis.

The upper or explosion proof containment is configured for adapting a second signal horn assembly in a stacked configuration thus providing a two-mile signal assembly. This arrangement allows conversion from half-mile horns to two-mile horns on site. The stacked horns, each having multiple acoustic drivers, use less power than stacked single driver horns with the same pressure. The ability to stack the horns further facilitates transport of the elongated horn assemblies by helicopter to off shore remote sites.

Coast Guard general requirements for aids to navigation located on artificial islands and fixed structures include, among other things, that the navigation aid, such as the fog horn described herein, must have a maximum frequency intensity between 100 and 1100 Hertz and have a rated range of at least a one-half mile. The structure must not exceed 25 ft. nor have more than eight sound sources.

It is therefore an object of the signal horn described herein to provide a marine, horn type navigational signal aid having the ability to meet federal requirements for a one-half mile signal aid and be expanded to meet the requirements for a two mile signal aid by simply attaching a second one-half mile signal to the top of the first.

It is still another object of the signal horn to provide a navigation signal aid having a plurality of emitters thereby reducing the power consumption generally required for such aids having a single emitter.

It is still another object of the instant signal horn to provide a means for stacking one emitter and resonator atop another while meeting the federal requirements for such signals.

It is yet another objective of the instant invention to provide signal apparatus that are easily transportable by helicopter for fast replacement and conversion of off shore navigational signal aids.

Yet another object of the invention is to provide emitter redundancy and reduced power consumption for one-half mile marine navigation signals.

5. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
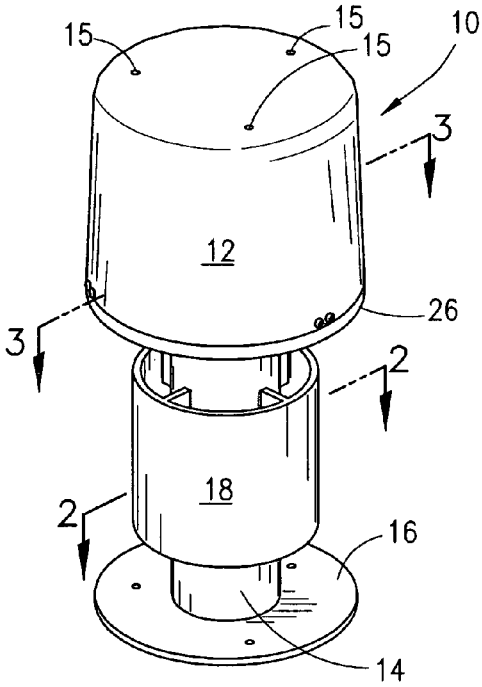
FIG. 1 is a vertical isometric view of the horn assembly.
Figure 2:
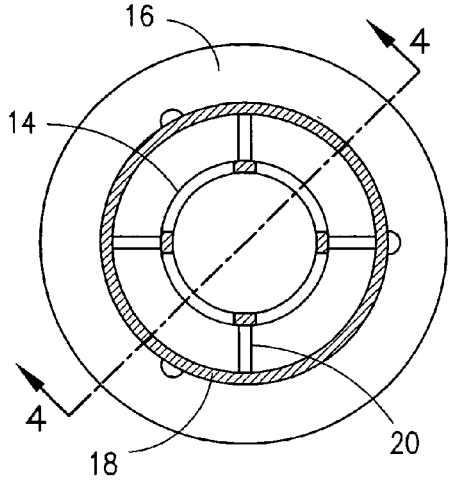
FIG. 2 is a cross section view of the horn taken along sight lines 2-2 seen in FIG. 1.
Figure 3:
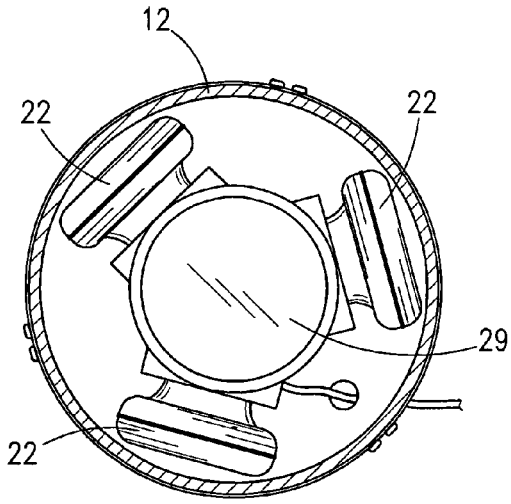
FIG. 3 is a cross section view of the horn taken along sight lines 3-3 seen in FIG. 1.
Figure 5:
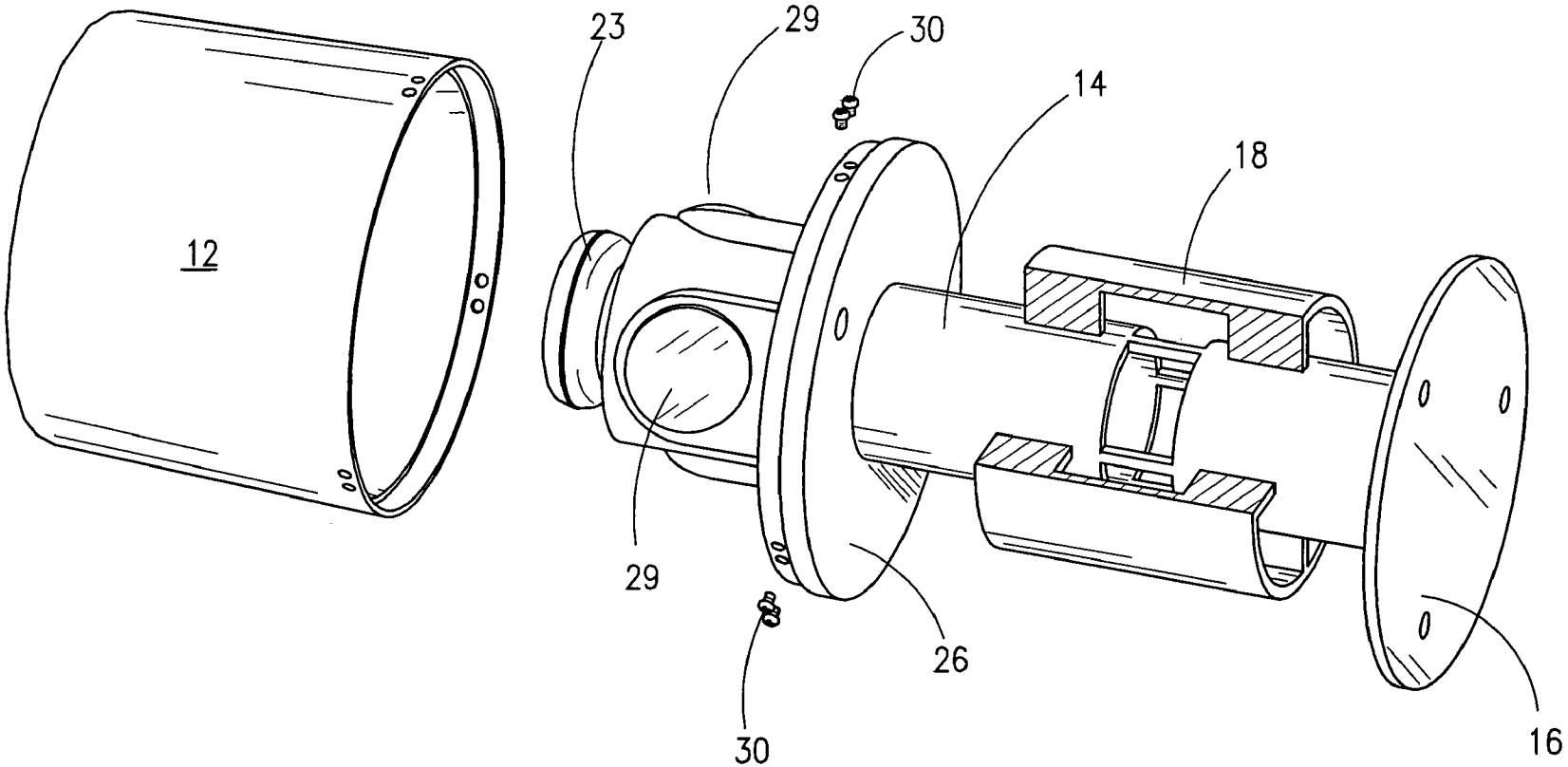
FIG. 5 is partial exploded view of the horn assembly.

As first seen in FIG. 1, the fog horn system assembly 10 is composed of an fog horn system assembly 10 upper compartment or housing 12, a tubular resonator or throat portion 14 extending from the upper compartment or housing 12, a mounting base plate 16 closing an end of the resonator or throat portion 14 and a standoff collar 18 surrounding the tubular resonator or throat portion 14. The standoff collar 18 is supported concentrically around the throat portion 14 with baffles 20, as shown in FIG. 2. The upper compartment 12 houses a plurality of horn emitters or drivers 22 generally arranged peripherally around the throat or resonator portion 14, as seen in FIG. 3 and may include an emitter 22 at the end of the throat portion 14, as shown in FIG. 5. The pedestal type foghorn system assembly 10 described herein is generally mounted vertically to a marine structure by its base plate 16.

Figure 4:
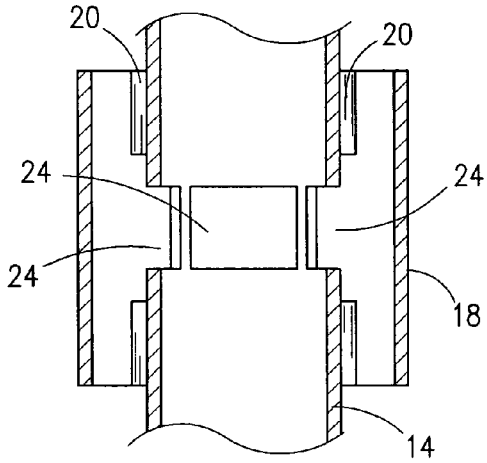
FIG. 4 is a cross section view of the horn taken along sight lines 4-4 seen in FIG. 2.

Generally rectangular orifices 24 located peripherally in the throat portion or the resonator 14, as seen in FIG. 4, allow the sound waves to pass from the throat member 14 to the areas between the baffles 20 and the collar 18 where the waves are divided before being projected upward and downward before being directed horizontally by base plate 16 and housing base plate 26 seen in FIG. 5.

As seen in FIG. 5, the heavy duty upper housing 12 is removable from the housing base plate 26 thus allowing access to the drivers 22 and retained thereto in a weather tight and explosion proof manner by screws 30 located on the lower base portion 26.

The upper housing further contains the power amplifier, control circuitry, power regulators (not shown) as well as the acoustic drivers 22,23 peripherally attached to the deep throat tubular portion 14 which is attached to the base member 16 having a general planer surface at the opposite end. The resonator or throat member 14 is peripherally penetrated by the generally rectangular orifices 24 and thus provides the horn's pitch. A single emitter or driver 23 may be used, if desired, to meet range requirements. However, additional emitters 22 may be added for better efficiency and redundancy.

Figure 6:
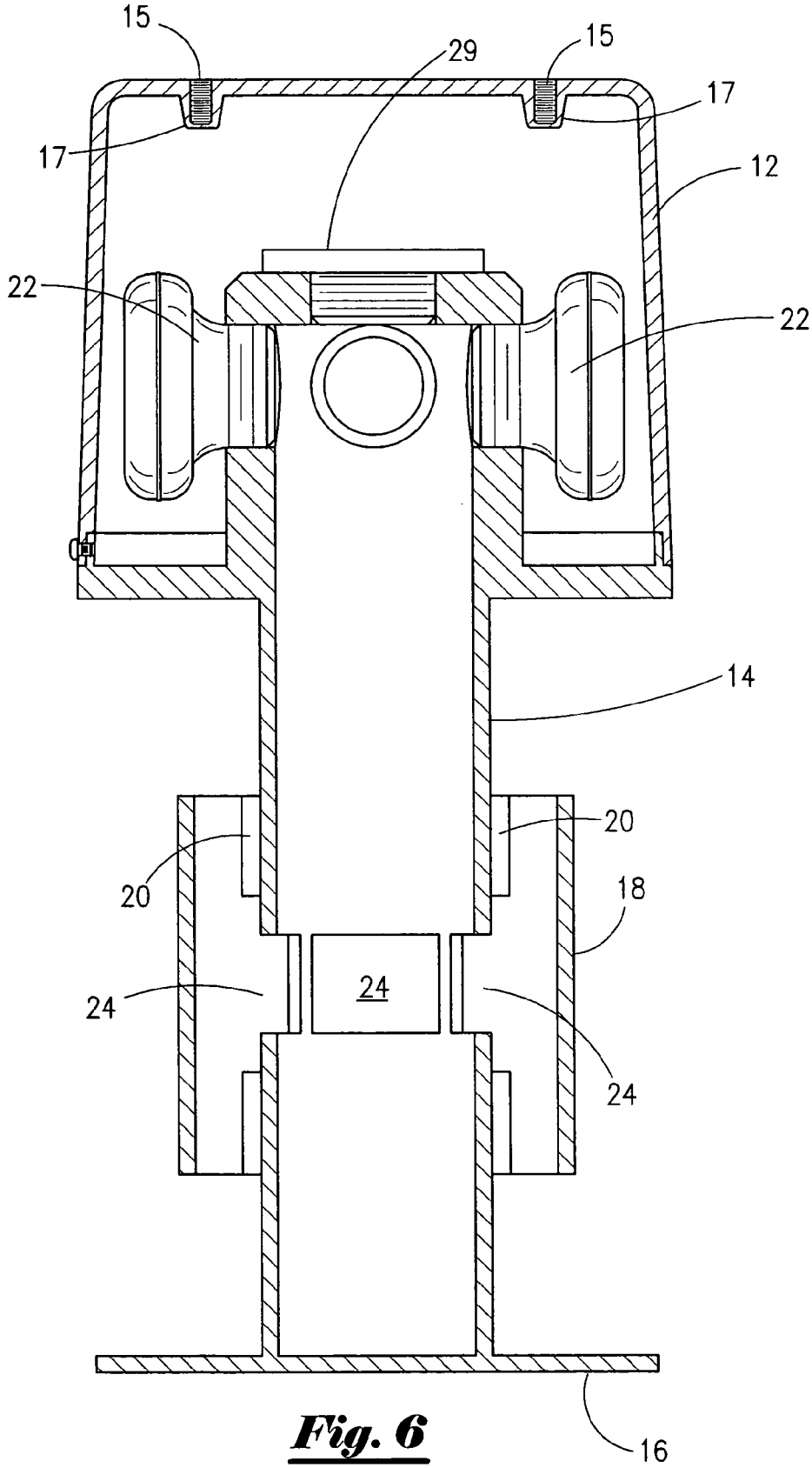
FIG. 6 is a full-length cross-section view of the horn assembly.
Figure 7:
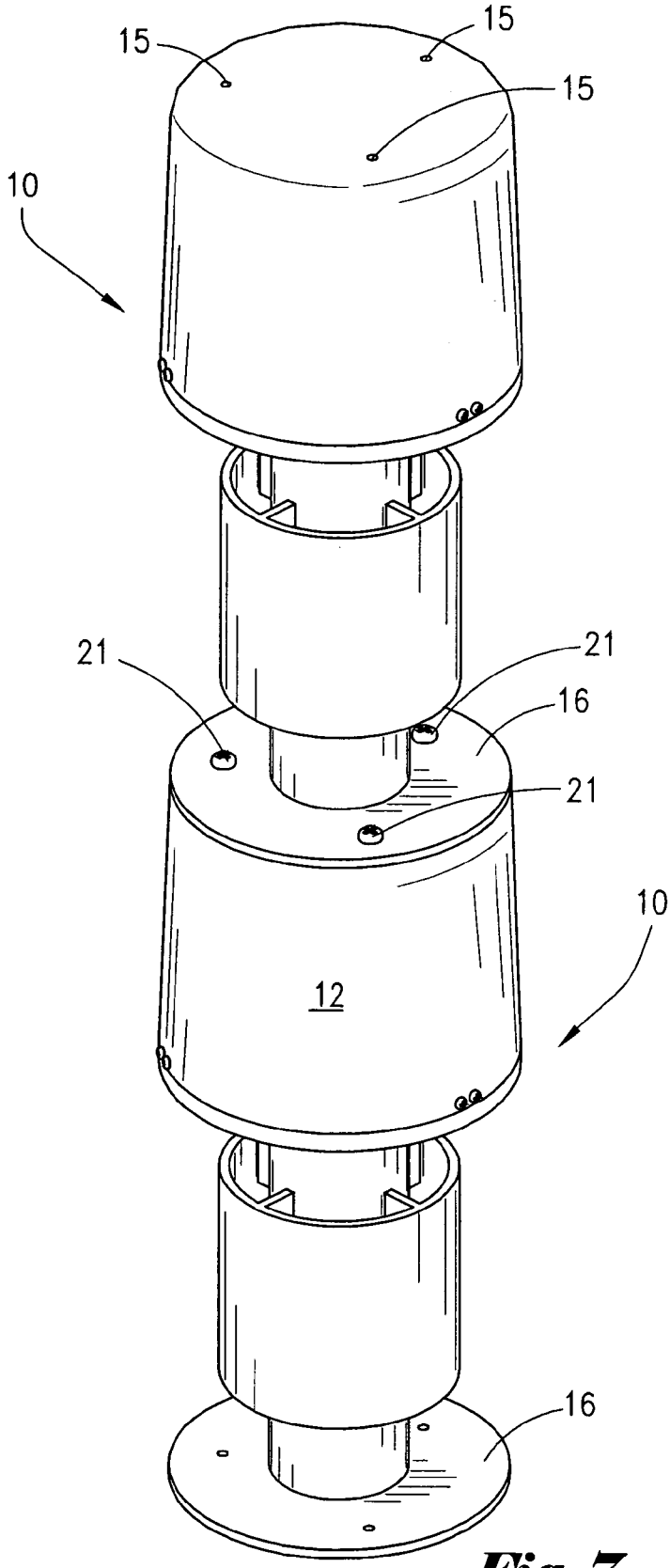
FIG. 7 is an isometric assembly view of the horns in a stacked embodiment.

An important aspect of the signal 10 is the blind hole tapped and threaded portion 15, first seen in FIG. 1, of a reinforced hard point 17, best seen in FIG. 6, provided in the upper surface of the cast metal housing 12 for attaching the pedestal base plate 16 of a second horn assembly 10 in a stacked manner, as seen in FIG. 7.

Sound pressure waves emanating from the emitters or drivers 22 pass downward through the throat of the resonator member 14 to the rectangular orifices 24 and reverberate off the base plate 16 before passing into the area between the baffles 20 and the collar 18 where the sound waves are allow to radiate outwards from each end of the collar and ultimately bounced off the outer surfaces of the tubular throat 14 and the lower base portion 26 and the base plate 16 before merging into a radial horizontally radiated sound wave.

One advantage of this signal horn system 10 is the ability to achieve different configurations of the electrical transducers/emitters 22 mounted on a single resonator 14. In one configuration, as seen in FIG. 5, a single emitter 23 is used that produces the required sound pressure level (SPL) while still providing a "self draining" orientation for the electrical transducer (emitter) 23. This same signal system 10 can also be reconfigured by removing threaded side plugs 29 and removing and plugging the site of the top transducer 23 and installing three transducers 22 in a horizontally radial configuration. This plural emitter configuration, seen in FIG. 6, still produces the required SPL only at lower power levels as compared to the single emitter configuration and without the need for a power consuming electrical inverter. This plural transducer configuration represents a more reliable signal system 10 in that reduced power is required for each transducer, thereby increasing the average time to failure for each transducer. Because electrical inverters are also a source of field failure, the design achieves additional levels of reliability because the multi-transducer impedance allows the system to be powered by the system batteries (not shown) without the need for applied voltages above the standard 12VDC available from the batteries used with the system. Although those skilled in the art could easily design a single transducer with the necessarily low impedance necessary so as not to require an electrical inverter, the advantage of a single emitter signal having redundancy through the use of plural emitters, reduction in power consumption by reducing demand and elimination of a power inverter, results in better efficiency, configuration ability and reduced maintenance cost.

The signal horn system 10 does not require any substantial reconfiguration to operate in either a plural emitter or single emitter mode and either mode may be used for one-half mile signal models. However, the single emitter configuration is preferable for self-draining applications such as when buoy mounting is required.

Another feature of signal system 10 is that the one-half mile signal system 10 may be easily stacked atop another one-half mile signal system 10 to produce a two-mile signaling system in the manner shown in FIG. 7. Since the signal system 10 is easily configured for plural emitters, the required range for a two-mile rated signal horn is easily achieved with a stacked arrangement. Although using a plurality of emitters mounted on a single resonator 14 is taught in technical literature it is important to note that such configurations are not usually vertical and are not designed for off shore or submersible conditions. The vertical arrangement of two stacked emitter systems 10 as seen in FIG. 7 results in a vertical height substantially less than that of prior art designs for such two-mile navigational signal horns. The prior art systems using multiple emitters were built with the vertical stacking of the resonators, one on top of the other. The signal system 10 uses plural emitters in a horizontal configuration to reduce over-all height. This reduction in height is very important for both rapid and economical deployment of the system. The signal system 10 may be successfully deployed with any number of emitters 22 in a horizontal configuration and is thus not limited to any specific numbers of emitters.

Figure 8:
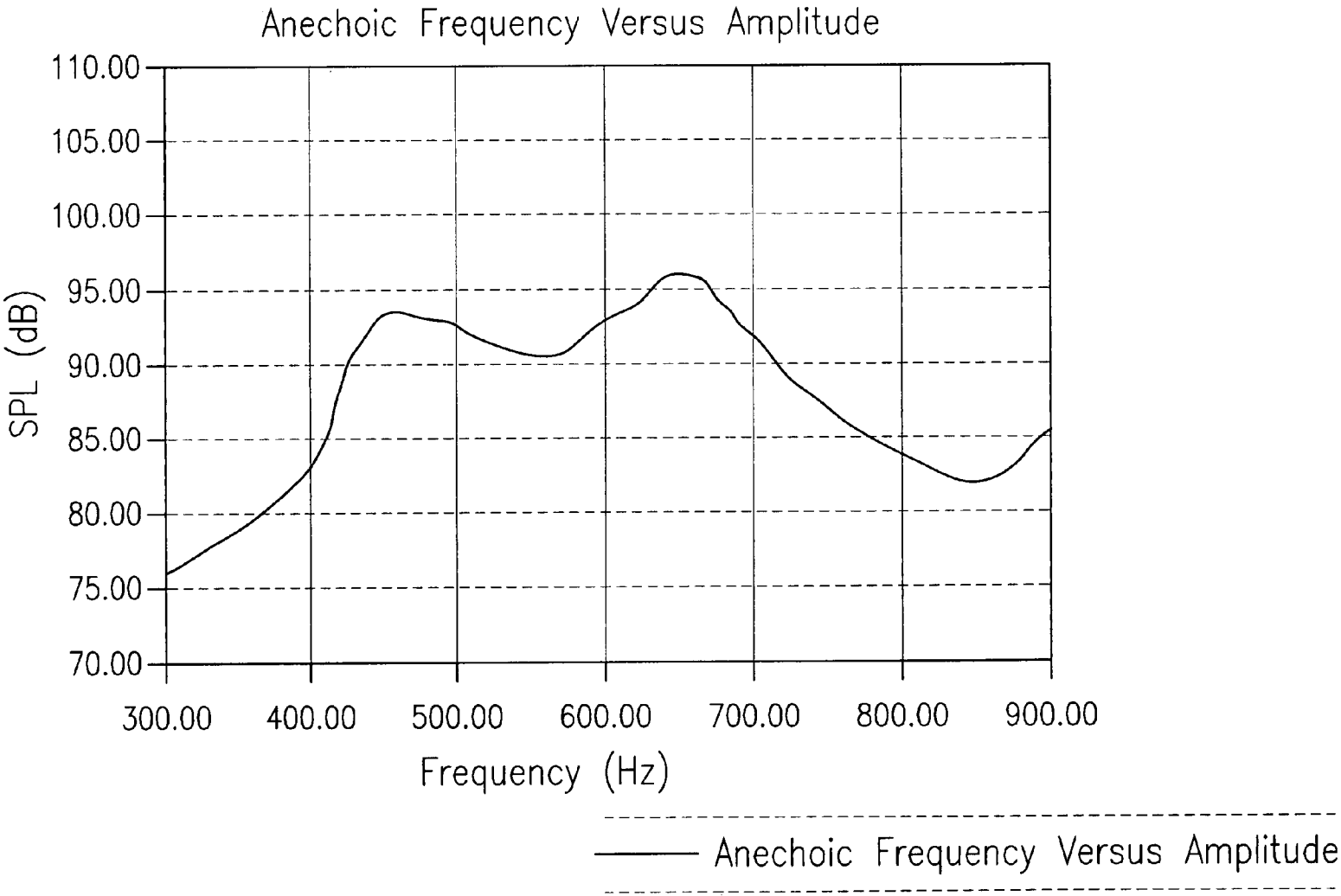
FIG. 8 is a graph of Anechoic frequency versus amplitude.

In general two-mile marine signal horn devices are rather large in their vertical dimension and require delivery to off shore hazardous sites by boat due to their large size. Such devices achieve the required two-mile sound pressure levels (SPL) by adding transducers (emitters) in a vertical configuration, the polarity of devices required to produce the acoustic summing necessary to achieve the specified SPL at the specified frequency required by federal regulations. In this case the signal system disclosed herein produces a SPL of between 90 and 95 decibels between 450 to 650 Hertz, as depicted in the FIG. 8 graph, well within the requirements of the Code of Federal Regulations governing one-half mile and two-mile marine navigational signal horns.

The smaller vertical dimensions of a typical one-half mile device as disclosed herein allows for transport by either boat or helicopter to distant off shore sites. If the devices are to be transported by helicopter they must be dimensioned to fit within the cargo bay of a helicopter. Obviously the smaller the helicopter the smaller the cargo bay and the less expensive the transport. Therefore, it is advantageous to make the marine signal horn 10 as small as possible and still achieve the required SPL.

The disclosed signal system 10 achieves the necessary SPL's by employing two of the one-half mile systems configured with three emitters 22 on a single resonator 14 also oriented in a vertical configuration. The resultant height and size reduction, achieved by using three emitters on each of two pedestal type vertically oriented resonators 14 having a constant diameter resonator and an overall height of less than five feet, allows for transport by the average size helicopter used in the gulf (or sea plane) as well as ship transportation to distant off shore sites. This reduction in height and the subsequent transportation via air allows for a substantial economic advantage as well as fast response and turnaround.

Figure 9:
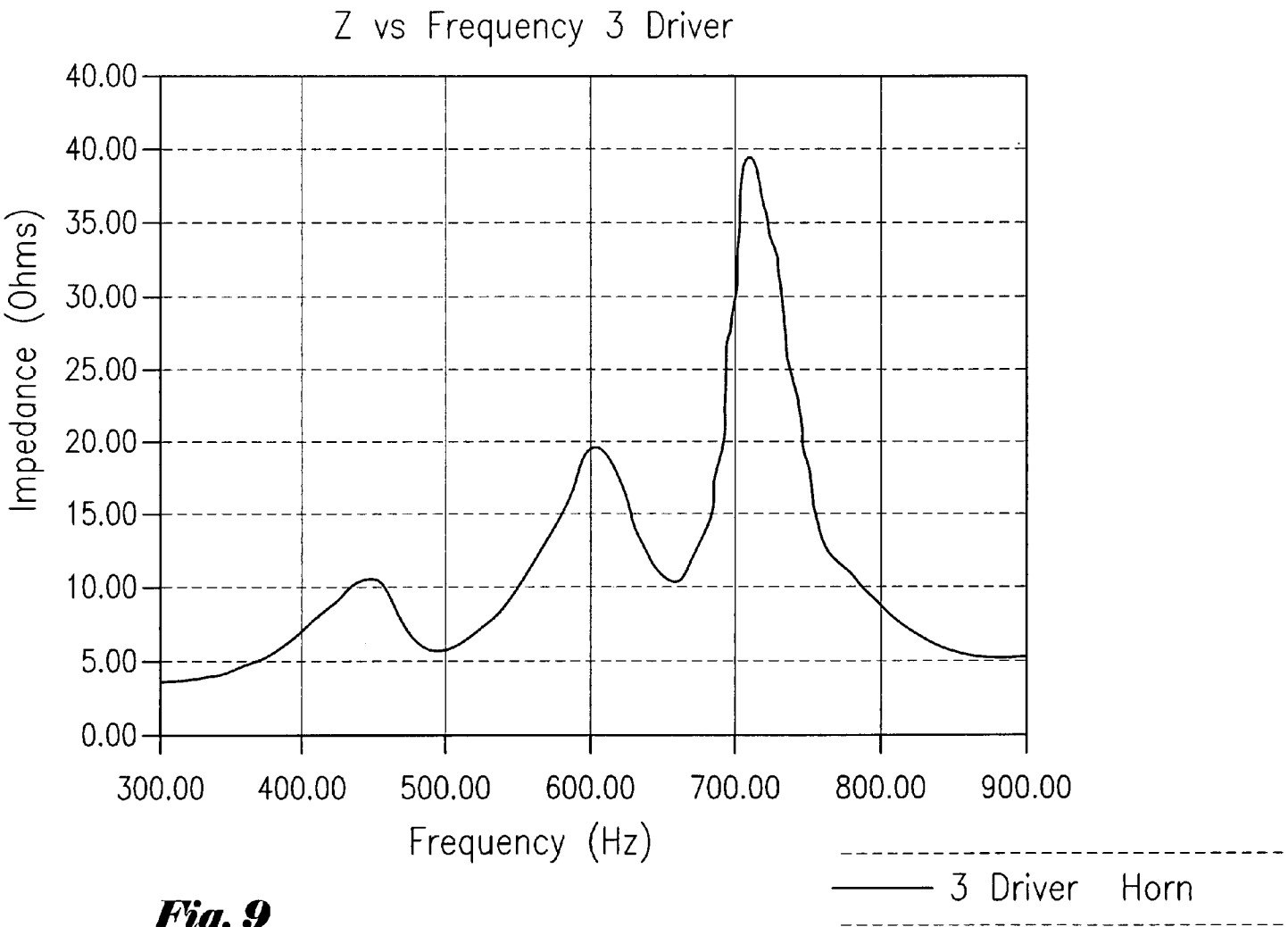
FIG. 9 is a graph of Z versus frequency 3 driver.

Use of a plurality of acoustic drivers 22 increases pressure within the tubular throat 14 to the desired level thus reducing the overall wattage necessary to derive the desired pitch and range required by a single driver. See graph in FIG. 9 for impedance verses frequency with 3 drivers. Reduced wattage translates into power savings, longer battery life and less maintenance.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A power efficient acoustical Helmholtz type marine navigational foghorn assembly commonly installed on remote off-shore unmanned well sites and buoys as a navigational warning aid for marine hazards, in conformance with regulations established by the United States Coast Guard the foghorn comprising:

a) a base plate having means for securing said foghorn vertically to said offshore well sites and buoys;

b) a tubular resonating member having a constant diameter throat and at least one sound pressure wave outlet orifice located approximately mid-way there along, said resonating member attached perpendicular to said base plate thereby closing one end of said tubular resonating member, said orifice location and its size and shape, along with diameter, length and wall thickness of said resonating member determining resonance of said Helmholtz type foghorn;

c) a tubular collar serving as a bidirectional acoustic wave guide surrounding said tubular resonating member in a standoff relationship surrounding each said sound pressure wave outlet orifice, spacing between said resonating member and said tubular collar contributing to resonance and pitch of said foghorn;

d) a manifold having a flange portion and a plurality of threaded ports attached to an end of said tubular resonating member located opposite said base plate, each of said threaded ports in sound pressure wave communication with said constant diameter throat of said tubular resonating member;

e) a plurality of electrical acoustic transducer sound emitters attached via said threaded ports located in said manifold;

f) a detachable watertight cover fully enclosing said acoustic transducer emitters having means for securing said cover to said flange portion and a means for attaching and fully supporting a second said Helmholtz type marine navigational foghorn assembly to an external upper surface of said cover.

2. The marine navigational foghorn assembly according to claim 1 wherein said detachable watertight explosion proof cover is a truncated cone.

3. The marine navigational foghorn assembly according to claim 1 wherein said sound pressure wave outlet is a rectangular orifice.

4. The marine navigational foghorn assembly according to claim 1 wherein said watertight explosion proof cover is a casting metal having integrally cast reinforced hard points having blind drilled threaded holes.

5. The marine navigational foghorn assembly according to claim 4 wherein said foghorn assembly comprises a first and second foghorn assembly said second foghorn assembly is attached vertically to the watertight housing of the first foghorn assembly by its said mounting base secured at said hard points.

6. The marine navigational foghorn assembly according to claim 5 wherein first and second foghorn assemblies combined has an overall height of less than twenty-five feet.

7. The marine navigational foghorn assembly according to claim 1 wherein said foghorn produces a SPL of between 90 and 95 (db) between 450 to 650 Hertz.

8. The marine navigational foghorn assembly according to claim 1 wherein said manifold is configured for three emitters equally spaced radially and one perpendicular to the other three, said manifold is common to all emitter sound pressure waves.

9. The marine navigational foghorn assembly according to claim 8 wherein said three emitters when combined have an impedance between 35 and 40 ohms between 700 and 800 Hz.

10. The marine navigational foghorn assembly according to claim 9 wherein said three emitters reduce overall power consumption.

11. The marine navigational foghorn assembly according to claim 10 wherein said three emitters having a combined impedance between 35 and 40 ohms between 700 and 800 Hz. eliminate the need for an electrical voltage inverter thus reducing onsite power requirement.

12. The marine navigational foghorn assembly according to claim 1 wherein said foghorn assembly has an overall height of less than five feet.

13. A power efficient acoustical Helmholtz type marine navigational foghorn assembly commonly installed on remote off-shore unmanned well sites and buoys as a navigational warning aid for marine hazards, in conformance with regulations established by the United States Coast Guard the foghorn comprising:

a) a base plate having means therein for securing said foghorn vertically to said offshore well sites and buoys;

b) a tubular resonating member having a constant diameter throat and at least one sound powered wave outlet orifice located approximately mid-way there along, said resonating member attached perpendicular to said base plate thereby closing one end of said tubular resonating member, said orifice location and its size and shape along with diameter, length and wall thickness of said resonating member determining resonance of said foghorn;

c) a tubular collar serving as a bi-directional acoustic wave guide surrounding said tubular resonating member in a standoff relationship surrounding each said sound pressure wave outlet orifice, spacing between said resonating member and said tubular collar contributing to resonance and pitch of said foghorn;

d) a manifold having a flange portion and plurality of threaded ports attached to an end of said tubular resonating member located opposite said base plate, each of said threaded ports in sound pressure wave communication with said constant diameter throat of said tubular resonating member;

e) at least one electrical acoustic transducer emitter attached via said threaded ports to said manifold, any threaded port not fitted with a said emitter is plugged;

f) a detachable, watertight truncated conical cover fully enclosing said acoustic transducer emitters having means for securing said cover to said flange portion and a means for attaching and fully supporting a second said Helmholtz type marine navigational foghorn assembly to an external upper surface of said cover.

14. The marine navigational foghorn assembly according to claim 13 wherein said cover further comprises hard points having blind threaded holes tapped.

15. The marine navigational foghorn assembly according to claim 13 wherein said foghorn produces a SPL of between 90 and 95 (db) between 450 to 650 Hertz.

16. The marine navigational foghorn assembly according to claim 13 wherein said foghorn is configured with three emitters having a combined impedance between 35 and 40 ohms between 700 and 800 Hz. thereby eliminating the need for an electrical voltage inverter thus reducing onsite power requirement.

17. The marine navigational foghorn assembly according to claim 16 wherein two said Helmholtz one-half mile rated marine navigational foghorn assemblies are combined to produce a omni-directional, two mile rated, hazard warning signal having an overall height of less than ten feet and less than eight emitters.

18. A process for improving the efficiency of an acoustical Helmholtz type marine navigational foghorn assembly commonly installed on off-shore remote unmanned well sites or buoys as a navigational warning aid for marine hazards, in conformance with regulations established by the United States Coast Guard comprising the steps of:

a) constructing a first and second navigational foghorn assembly having a SPL of between 90 and 95 (db) between 450 to 650 Hertz comprising:

i) a base plate having means for securing said foghorn vertically to said offshore well sites or buoys;

ii) a tubular resonating member having a constant diameter throat and at least one sound pressure wave outlet orifice located approximately mid-way there along, said resonating member attached perpendicular to said base plate, thereby closing one end of said tubular resonating member, said orifice location, its shape, and the diameter, length and wall thickness of said resonating member determining resonance of the foghorn;

iii) a tubular collar serving as an acoustic wave guide surrounding said tubular resonating member in a standoff relationship surrounding each said sound pressure wave outlet orifice, spacing between said resonating member and said tubular collar contributing to resonance of said foghorn;

iv) a manifold having a flange portion and a plurality of threaded ports attached to an end of said tubular resonating member located opposite said base plate, said threaded ports in sound pressure wave communication with said constant diameter throat of said tubular resonating member;

v) a plurality of electrical acoustic transducer sound emitters attached via said threaded ports located in said manifold;

vi) a detachable watertight cover fully enclosing said acoustic transducer emitters having means for securing said cover to said flange portion and a means for attaching said base plate of a second said Helmholtz type marine navigational foghorn assembly to an external surface of said cover; and b) attaching said first foghorn assembly to said second foghorn assembly in a manner that does not exceed a combined overall height of ten feet.

* * * * *